US011535471B1

(12) United States Patent
Wurmfeld

(10) Patent No.: US 11,535,471 B1
(45) Date of Patent: Dec. 27, 2022

(54) SYSTEMS AND METHODS FOR DISPENSING A PRINTED DOCUMENT FROM A PRINTER MACHINE USING A DISPENSING DEVICE

(71) Applicant: Capital One Services, LLC, McLean, VA (US)

(72) Inventor: David Kelly Wurmfeld, Palm Bay, FL (US)

(73) Assignee: Capital One Services, LLC, McLean, VA (US)

( * ) Notice: Subject to any disclaimer, the term of this patent is extended or adjusted under 35 U.S.C. 154(b) by 0 days.

(21) Appl. No.: 17/658,108

(22) Filed: Apr. 6, 2022

(51) Int. Cl.
*B65H 5/04* (2006.01)
*B65H 7/02* (2006.01)
*B65H 5/06* (2006.01)

(52) U.S. Cl.
CPC ..... *B65H 5/04* (2013.01); *B65H 5/068* (2013.01); *B65H 7/02* (2013.01); *B65H 2511/51* (2013.01); *B65H 2513/52* (2013.01); *B65H 2601/10* (2013.01); *B65H 2801/03* (2013.01)

(58) Field of Classification Search
CPC ..... B65H 5/068; B65H 2513/53
See application file for complete search history.

(56) References Cited

U.S. PATENT DOCUMENTS 9,227,800 B2 * 1/2016 Martin ..... G06Q 20/347
10,689,220 B2 * 6/2020 Gonzalez Perello .. B65H 31/02
2004/0217541 A1 * 11/2004 Horio ..... B65H 3/46 271/121

FOREIGN PATENT DOCUMENTS

WO WO-2017168927 A1 * 10/2017 ..... B65H 9/00

* cited by examiner

*Primary Examiner* — Howard J Sanders
(74) *Attorney, Agent, or Firm* — Bookoff McAndrews, PLLC

(57) ABSTRACT

Disclosed are methods and systems for dispensing a printed document from a printer machine with a dispensing device. For instance, a document being printed out from the printer machine may be monitored for, and a determination that a document is being printed out from the printer machine may be made based on the monitoring. The printed document may be engaged with an arm mechanism of the dispensing device, the printed document may be urged towards a slot of the dispensing device with the arm mechanism, and the printed document may be dispensed out of the slot with the arm mechanism.

20 Claims, 7 Drawing Sheets

SYSTEMS AND METHODS FOR DISPENSING A PRINTED DOCUMENT FROM A PRINTER MACHINE USING A DISPENSING DEVICE

TECHNICAL FIELD

Various embodiments of the present disclosure relate generally to printing documents, and, more particularly, to systems and methods for dispensing a printed document from a printer machine using a dispensing device.

BACKGROUND

Some types of documents, such as cashier's checks or other types of secure document, may require certain security features in generating and issuing the document. These required security features may make it difficult to print and securely dispense these types of documents. Further, current printer machines may be inadequate to securely dispense such documents. Accordingly, a need exists for securely dispensing printed documents.

The systems and methods of the present disclosure may solve one or more of the problems set forth above and/or other problems in the art. The scope of the current disclosure, however, is not defined by the attached claims, and not by the ability to solve any specific problem. The background description provided herein is for the purpose of generally presenting the context of the disclosure. Unless otherwise indicated herein, the materials described in this section are not prior art to the claims in this application and are not admitted to be prior art, or suggestions of the prior art, by inclusion in this section.

SUMMARY

According to certain aspects of the disclosure, systems and methods are disclosed for dispensing a printed document from a printer machine using a dispensing device. Each of the examples disclosed herein may include one or more of the features described in connection with any of the other disclosed examples.

In one embodiment, methods for dispensing a printed document from a printer machine with a dispensing device may be described. An example method may include monitoring for a document being printed out from the printer machine, determining that a document is being printed out from the printer machine based on the monitoring, engaging the printed document with an arm mechanism of the dispensing device, urging the printed document towards a slot of the dispensing device with the arm mechanism, and dispensing the printed document out of the slot with the arm mechanism.

In another embodiment, printed document dispensing systems may be described. An example system may include a printer machine, and a dispensing device mounted to the printer machine. The dispensing device may include a body having a slot, an arm mechanism moveably coupled to the body, and a controller. The controller may be configured to monitor for a document being printed out from the printer machine, determine that a document is being printed out from the printer machine based on the monitoring, engage the printed document with the arm mechanism, urge the printed document towards the slot with the arm mechanism, and dispense the printed document out of the slot with the arm mechanism.

In a further embodiment, methods for dispensing a printed document from a printer machine with a dispensing device. An example, method may include monitoring for a document being printed out from the printer machine using one or more sensors, and determining that a document is being printed out from the printer machine when at least one of the one or more sensors is triggered. The method may also include engaging the printed document with one or more wheels of an arm mechanism of the dispensing device via a friction grip, moving the arm mechanism axially along a track of the dispensing device to urge the printed document towards a slot of the dispensing device with the arm mechanism, and dispensing the printed document out of the slot with the arm mechanism.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION OF EMBODIMENTS

Figure 1:
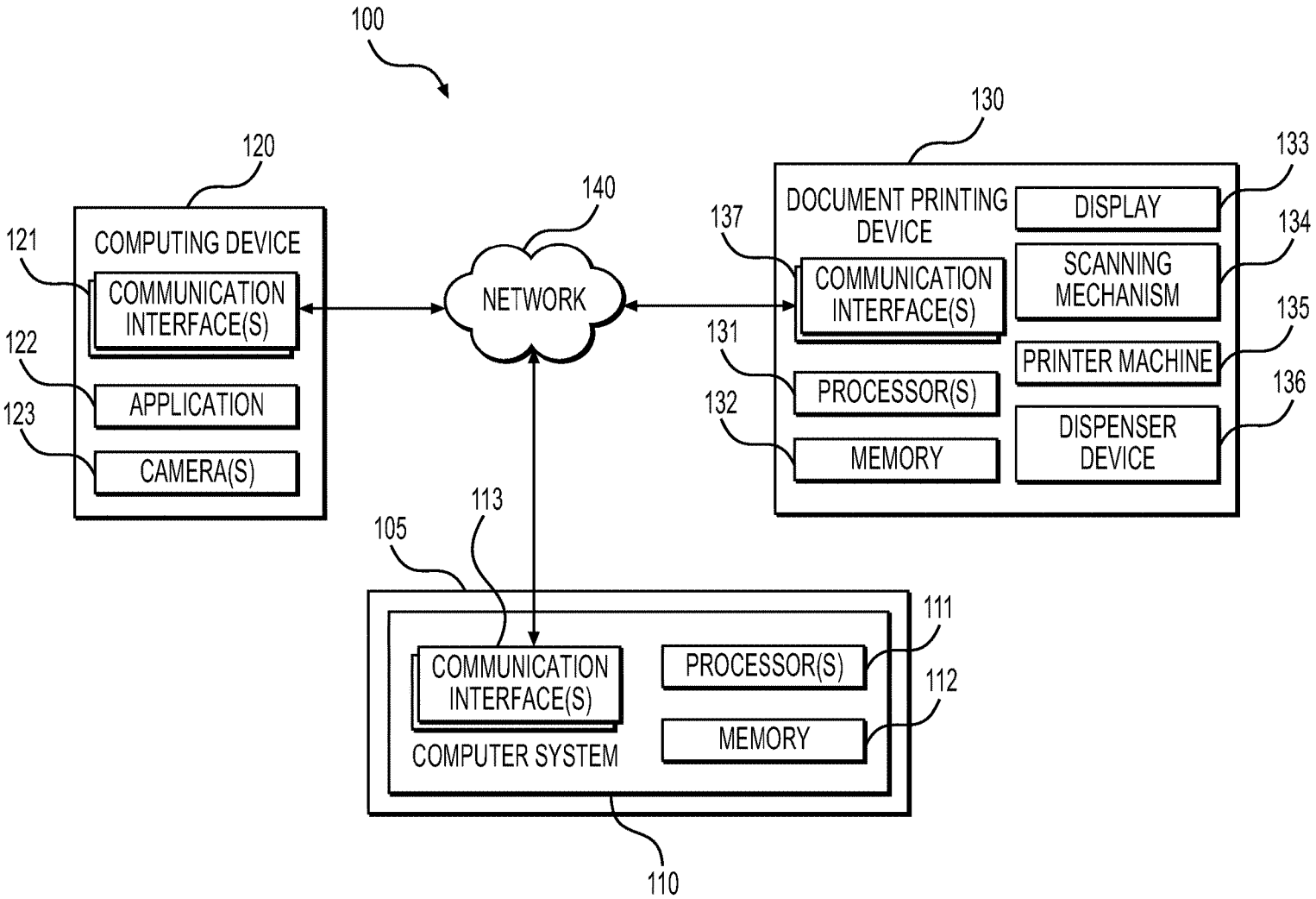
FIG. 1 depicts an exemplary system architecture for dispensing a printed document from a printer machine using a dispensing device, according to one or more embodiments.

Various embodiments of the present disclosure relate generally to printing documents and, more particularly, to systems and methods for dispensing a printed document from a printer machine with a dispensing device.

The terminology used below may be interpreted in its broadest reasonable manner, even though it is being used in conjunction with a detailed description of certain specific examples of the present disclosure. Indeed, certain terms may even be emphasized below; however, any terminology intended to be interpreted in any restricted manner will be overtly and specifically defined as such in this Detailed Description section. Both the foregoing general description and the following detailed description are exemplary and explanatory only and are not restrictive of the features, as claimed.

In this disclosure, the term "computer system" generally encompasses any device or combination of devices, each device having at least one processor that executes instructions from a memory medium. Additionally, a computer system may be included as a part of another computer system.

In this disclosure, the term "based on" means "based at least in part on." The singular forms "a," "an," and "the" include plural referents unless the context dictates otherwise. The term "exemplary" is used in the sense of "example" rather than "ideal." The term "or" is meant to be inclusive and means either, any, several, or all of the listed items. The terms "comprises," "comprising," "includes," "including," or other variations thereof, are intended to cover a non-exclusive inclusion such that a process, method, or product that comprises a list of elements does not necessarily include only those elements, but may include other elements not expressly listed or inherent to such a process, method, article, or apparatus. Relative terms, such as, "substantially" and "generally," are used to indicate a possible variation of ±10% of a stated or understood value.

It will also be understood that, although the terms first, second, third, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

In general, the present disclosure provides for systems and methods for dispensing a printed document from a printer machine using a dispensing device. The dispensing device may be mounted or otherwise attached to a printer machine such that the dispensing device is fully detachable from the printer machine. The printer machine may be an off-the-shelf type of printer available to consumers. The printer machine may print documents in any conventional manner, and may dispense printed documents onto an output tray of the printer machine. As used herein, a "printed document" includes a partially printed or actively printing document (e.g., a document that has begun to printed and dispensed from the printer machine, but has not fully or completely been dispensed from the printer machine) and/or a completely printed document (e.g., a document that has been fully dispensed from the printer machine and onto the output tray).

The dispensing device may include a body that includes a surface that faces the output tray when the dispensing device is mounted to the printer machine. The dispensing device may include an arm mechanism that includes one or more wheels for gripping or otherwise grabbing a printed document from the output tray of the printer machine. The arm mechanism may be mounted on one or more tracks and may be movable by a pulley system and controlled by a controller of the dispensing device. The controller of dispensing device may control the arm mechanism to move the arm mechanism along the one or more tracks. In this way, the arm mechanism may be moved to grip a printed document and urge (e.g., push or pull) the printed document toward and out of the slot of dispensing device.

The dispensing device may also include a sensor system including one or more sensors for detecting a status of the printed document. For example, the sensor system may detect when a document is being printed and the controller of the dispensing device may control the arm mechanism in response to the detection.

The dispensing device may also include one or more security features. For example, if a printed document is not dispensed out of slot in a predetermined amount of time, a jam or other error may be determined to have occurred. The controller may stop movement of the arm mechanism so that a technician or other user can fix the jam and remove the printed document manually from the output tray. Further, if a user fails to remove the printed document from the slot in a predetermined amount of time, the controller may control the arm mechanism to retract the arm mechanism such that the printed document is retracted back into the slot. Thus, if the user does not take the printed document out of the slot in time, the printed document may be prevented from being taken by an unauthorized user.

Thus, the dispensing device may provide an improved dispensing mechanism for dispensing printed documents from a printer machine. For example, the dispensing device may grab a printed document from the output tray and dispense the printed document out of a slot or otherwise from an end of the output tray. The dispensing device may be designed to be fitted and mounted on any type of printer machine such that the dispensing device is attachable to and fully detachable from the any type of printer machine. While exemplary embodiments herein relate to a cashier's check kiosk and printing cashier's checks, it is understood that the dispensing device described herein may be used with any type of printer machine for dispensing any type of document.

Referring now to the appended drawings, FIG. 1 is a diagram depicting an exemplary system environment 100 for securely generating and issuing a document, according to embodiments of the present disclosure. As shown in FIG. 1, system environment 100 may include a computer system 110, a user computing device (or a device associated with a user) 120, a document printing device 130, and a network 140. Computer system 110 and user computing device 120, and computer system 110 and document printing device 130, may be in communication with each other via network 140, as detailed below.

Figure 5:
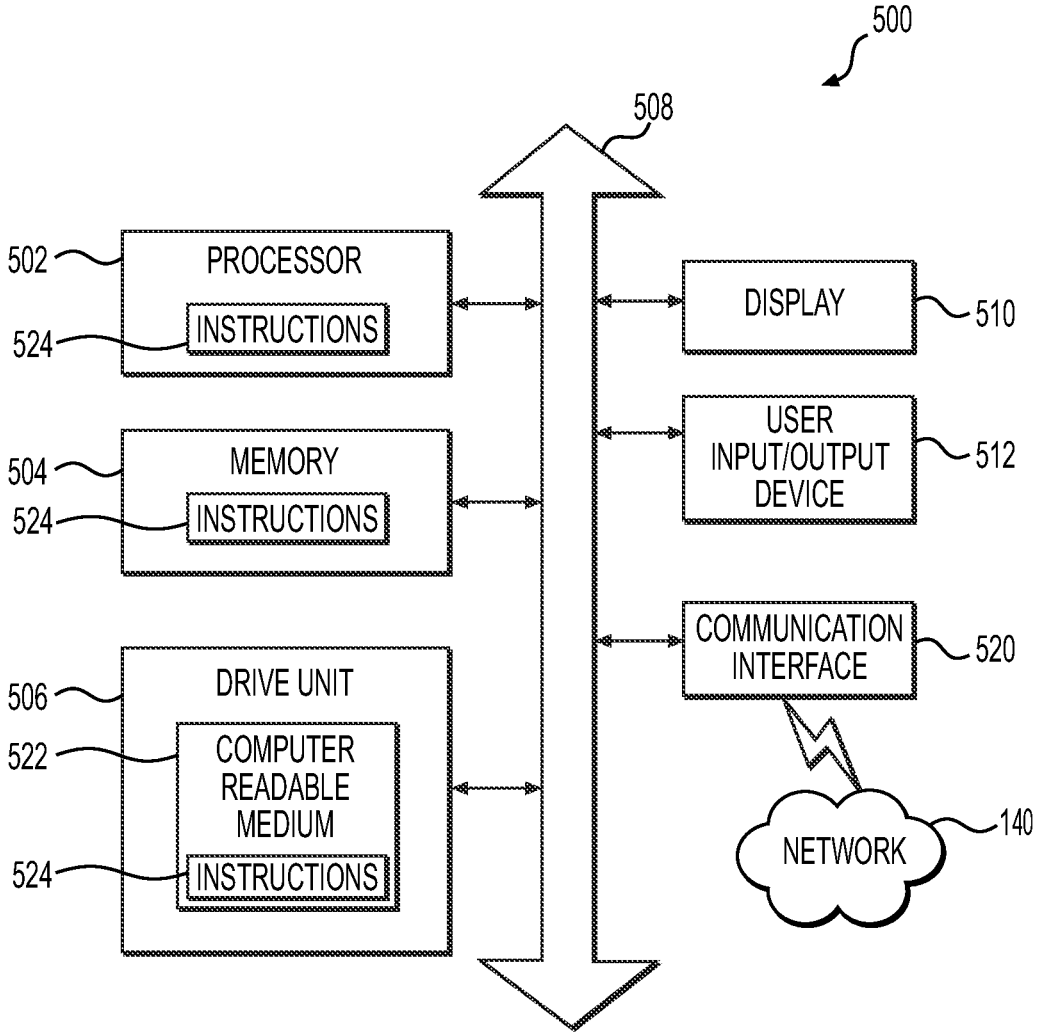
FIG. 5 depicts an example system that may execute techniques presented herein.

The computer system 110 may include computing systems, such as computer 500 described with respect to FIG. 5. As such, computer system 110 may include one or more processors 111 and a memory 112 for storing and executing applications or software modules of system environment 100. For example, computer system 110 may include one or more software modules to communicate with user devices and/or other computing devices 120 through network 140, such as the Internet. Further, the one or more processors 111 may be configured to access the memory 112 and execute processor-readable instructions, which when executed by the processors 111 configures the processors 111 to perform a plurality of functions of the system environment 100. For example, the one or more processors 111 may include one or more processors 111 for dispensing a printed document, as detailed further below.

Computer system 110 may include one or more communication interfaces 113. Communication interface 113 may include one or more cellular radios, Bluetooth, WiFi, near-field communication radios, or other appropriate communication devices for transmitting and receiving information. As can be seen in FIG. 1, communication interface 113 facilitates communication between computer system 110 and network 140. Multiple communication interfaces 113 may be included in computer system 110 for providing multiple forms of communication between computer system 110 and computing device 120 and/or document printing device 130 via network 140. For example, communication may be achieved with network 140 through wireless communication (e.g., WiFi, radio communication, etc.) and/or a wired data connection (e.g., a universal serial bus, an onboard diagnostic system, etc.) or other communication modes, such as a local area network (LAN), wide area network (WAN) such as the Internet, a telecommunications network, a data network, or any other type of network.

Computer system 110 may be configured to receive data from other components (e.g., user computing device 120 and/or document printing device 130) of system environment 100 via network 140. Computer system 110 may further be configured to utilize the received data by inputting the received data into an algorithm to produce a result (e.g., generate an image of a document, as detailed below). Information indicating the result may be transmitted to user computing device 120 and/or the document printing device 130 over network 140. In some embodiments, the computer system 110 may be referred to as a server system that provides a service including providing the information indicating the received data and/or the result to the user computing device 120 and/or the document printing device 130. Computer system 110 may be part of an entity 105, which may include any type of company, organization, or institution that implements one or more applications. In some examples, entity 105 may be a financial services provider.

Computer system 110 may implement one or more applications of entity 105. The one or more applications may be downloaded, installed, and executed by user computing device 120, and may include applications for securely generating and printing a document, as detailed below.

Network 140 may be any suitable network or combination of networks and may support any appropriate protocol suitable for communication of data to and from the computer system 110 and between various other components in the system environment 100 (e.g., user computing device 120 and/or document printing device 130). Network 140 may include a public network (e.g., the Internet), a private network (e.g., a network within an organization), or a combination of public and/or private networks. Network 140 may be configured to provide communication between various components depicted in FIG. 1. Network 140 may comprise one or more networks that connect devices and/or components in the network layout to allow communication between the devices and/or components. For example, the network may be implemented as the Internet, a wireless network, a wired network (e.g., Ethernet), a local area network (LAN), a Wide Area Network (WANs), Bluetooth, Near Field Communication (NFC), or any other type of network that provides communications between one or more components of the network layout. In some embodiments, network 140 may be implemented using cell and/or pager networks, satellite, licensed radio, or a combination of licensed and unlicensed radio.

Computing device 120 may be in communication with computer system 110 via network 140. Computing device 120 may be a computer system that is operated by a user, such as a mobile device (e.g., smartphone, tablet, pager, personal digital assistant (PDA)), a computer (e.g., laptop computer, desktop computer, server), or a wearable device (e.g., smart watch). Computing device 120 can also include any other media content player, for example, a set-top box, a television set, a video game system, or any electronic device capable of providing or rendering data. Computing device 120 may optionally be portable and/or may be handheld. Computing device 120 may include a memory, one or more processors, communication interfaces, input devices, and output devices, as detailed further below with reference to FIG. 5. It is understood that computing device 120 may include one or more computing devices accessed by one or more users. For example, a first user may use a first computing device 120 and a second user may use a second computing device 120.

Computing device 120 may include one or more communication interfaces 121. Communication interface 121 may include one or more cellular radios, Bluetooth, WiFi, near-field communication radios, or other appropriate communication devices for transmitting and receiving information. As can be seen in FIG. 1, communication interface 121 facilitates communication between user computing device 120 and network 140. Multiple communication interfaces 121 may be included in user computing device 120 for providing multiple forms of communication between user computing device 120 and computer system 110 via network 140. For example, communication may be achieved with network 140 through wireless communication (e.g., WiFi, radio communication, NFC, Bluetooth, etc.) and/or a wired data connection (e.g., a universal serial bus, an onboard diagnostic system, etc.) or other communication modes, such as a local area network (LAN), wide area network (WAN) such as the Internet, a telecommunications network, a data network, or any other type of network.

Computing device 120 may operate a client program, also referred to as a user application 122 or third-party application, used to communicate with the computer system 110. This user application 122 may be used to provide information (e.g., information for the document) to the computer system 110 and to receive information from the computer system 110. User application 122 may include a web-based application accessed through a web browser of user computing device 120 via network 140. In some examples, the user application 122 may be a mobile application or other application that is run on computing device 120.

Computing device 120 may also include one or more cameras 123 or similar devices. The one or more cameras 123 may scan code data and/or otherwise capture an image of the code data, as detailed further below. The code data may include a scannable code, such as a quick response (QR) code, a data matrix, a barcode, or any other type of scannable code. It is understood that the one or more cameras 123 may include any type of camera device and/or other type of scanning or image capturing device. Computing device 120 may also include other components, such as a positioning receiver (e.g., GPS device), processors, memory, and/or any other components for a computing device, such as those described below with reference to FIG. 5.

Document printing device 130 may include computing systems, such as computer 500 described with respect to FIG. 5. Document printing device 130 may include one or more processors 131 and a memory 132 for storing and executing applications or software modules of document printing device 130. For example, document printing device 130 may include one or more software modules to communicate with user devices and/or other computing devices 120 through network 140, such as the Internet. Further, the one or more processors 131 may be configured to access the memory 132 and execute processor-readable instructions, which when executed by the processors 131 configures the processors 131 to perform a plurality of functions of the system environment 100. For example, the one or more processors 131 may include one or more processors 131 for printing a document, as detailed further below.

Document printing device 130 may also include a display 133, a scanning mechanism 134, a printer machine 135, and a dispenser device 136. The display 133 may include any type of display for displaying information of system environment 100. For example, the one or more processors 111 of computer system 110 may cause display 133 (e.g., via network 140) to display a code (e.g., a QR code), a printing status, an instruction, an error message, or any other type of display or graphical user interface of system environment 100, as detailed further below. The display 133 may display a new (e.g., different) code periodically, as detailed further below.

Scanning mechanism 134 may include any type of scanning mechanism for scanning a scannable code. For example, scanning mechanism 134 may include a digital or printed barcode data scanning device that can scan or otherwise read 1D or 2D barcodes from digital media (e.g., from a mobile phone display) and/or from printed media (e.g., printed on paper). Scanning mechanism 134 may be configured to scan any type of barcode or similar code, such as, for example, QR codes, data matrix codes, PDF417 codes, EAN 128 codes, UPC-A codes, colorful codes, or any other type of scannable code. The one or more processors 131 of document printing device 130 may transmit or otherwise send authentication information of the scanned code to computer system 110 via network 140, as detailed further below.

Printer machine 135 may include any type of printer for printing documents. For example, printer machine 135 may include a laser printer, an inkjet printer, or the like. In some examples, printer machine 135 may print with a specialty toner or ink, such as, for example, a magnetic toner or ink, for printing certain types of documents. As used herein, "specialty toner" or "specialty ink" includes any type of toner or ink other than standard toner or ink for printing certain types of documents that require additional security or fraud prevention. For example, printer machine 135 may utilize magnetic ink character recognition (MICR) toner cartridges for printing banking documents, such as cashier's checks or other types of checks or banking documents. The specialty toner or ink may provide added security in printing certain types of documents. It is understood that printer machine 135 may utilize any type of toner or ink, as necessary.

Dispenser device 136 may include a device mounted to printer machine 135 for dispensing printed documents from printer machine 135 out of document printing device 130. For example, dispenser device 136 may include an arm or other mechanism for interacting with a printed document in order to pull, push, or otherwise urge the printed document out of a slot of the document printing device 130. In this way, the printed document may be presented to a user so that the user can pick up or otherwise obtain the printed document. Dispensing device 136 may also be configured to retrieve a printed document back into document printing device 130, as detailed further below. While described herein as a separate device mounted to the printer machine 135 that is fully detachable from the printer machine 135, it is understood that the dispenser device 136 may be an integral part of printer machine 135 such that dispenser device 136 is not a separate device.

Document printing device 130 may include one or more communication interfaces 137. Communication interface 137 may include one or more cellular radios, Bluetooth, WiFi, near-field communication radios, or other appropriate communication devices for transmitting and receiving information. As can be seen in FIG. 1, communication interface 137 facilitates communication between document printing device 130 and network 140. Multiple communication interfaces 137 may be included in document printing device 130 for providing multiple forms of communication between document printing device 130 and computer system 110 via network 140. For example, communication may be achieved with network 140 through wireless communication (e.g., WiFi, radio communication, etc.) and/or a wired data connection (e.g., a universal serial bus, an onboard diagnostic system, etc.) or other communication modes, such as a local area network (LAN), wide area network (WAN) such as the Internet, a telecommunications network, a data network, or any other type of network.

In general, a user may use computing device 120 to input information (e.g., via application 122) for the document and send the information to computer system 110. For a cashier's check, the information may include a payee name, a payment amount, and/or a memo. When the computer system 110 has received and verified the information, the computer system 110 may generate an image of the document. The application 122 may then display a code (e.g., QR code) to be scanned. The user may take the computing device 120 to the document printing device 130 and scan the code (e.g., a first code) on the application 122 with the scanning mechanism 134 of the document printing device 130. Next, the user may use the cameras 123 of the computing device 120 to scan the code (e.g., a second code) on the display 133 of the document printing device 130 with the computing device 120. When both codes have been scanned and verified, the computer system 110 may transmit the image of the document to the document printing device 130 and may cause the document printing device 130 to print the image of the document via printer machine 135. The dispenser device 136 may grab or otherwise grip the printed document from printer machine 135 and urge the printed document out of a slot of the document printing device 130. In this way, the user may retrieve or otherwise remove the printed document from the document printing device 130. It is understood that dispenser device 136 may be used on any type of printer machine 135 for printing any type of document.

Figure 2A:
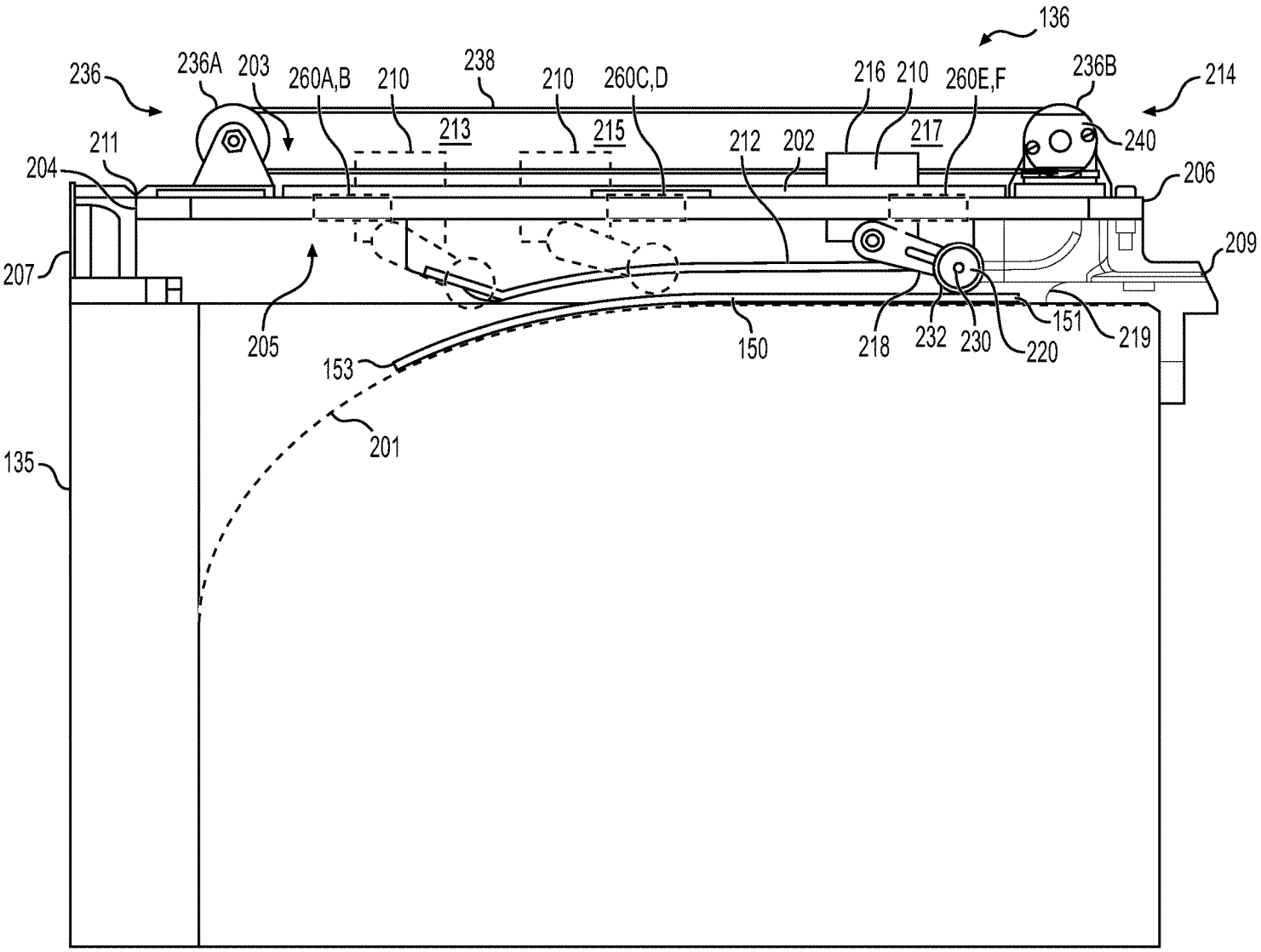
FIGS. 2A-2C depict various schematic views of an exemplary dispenser device mounted on a printer machine of the system architecture of FIG. 1, according to one or more embodiments.
Figure 2B:
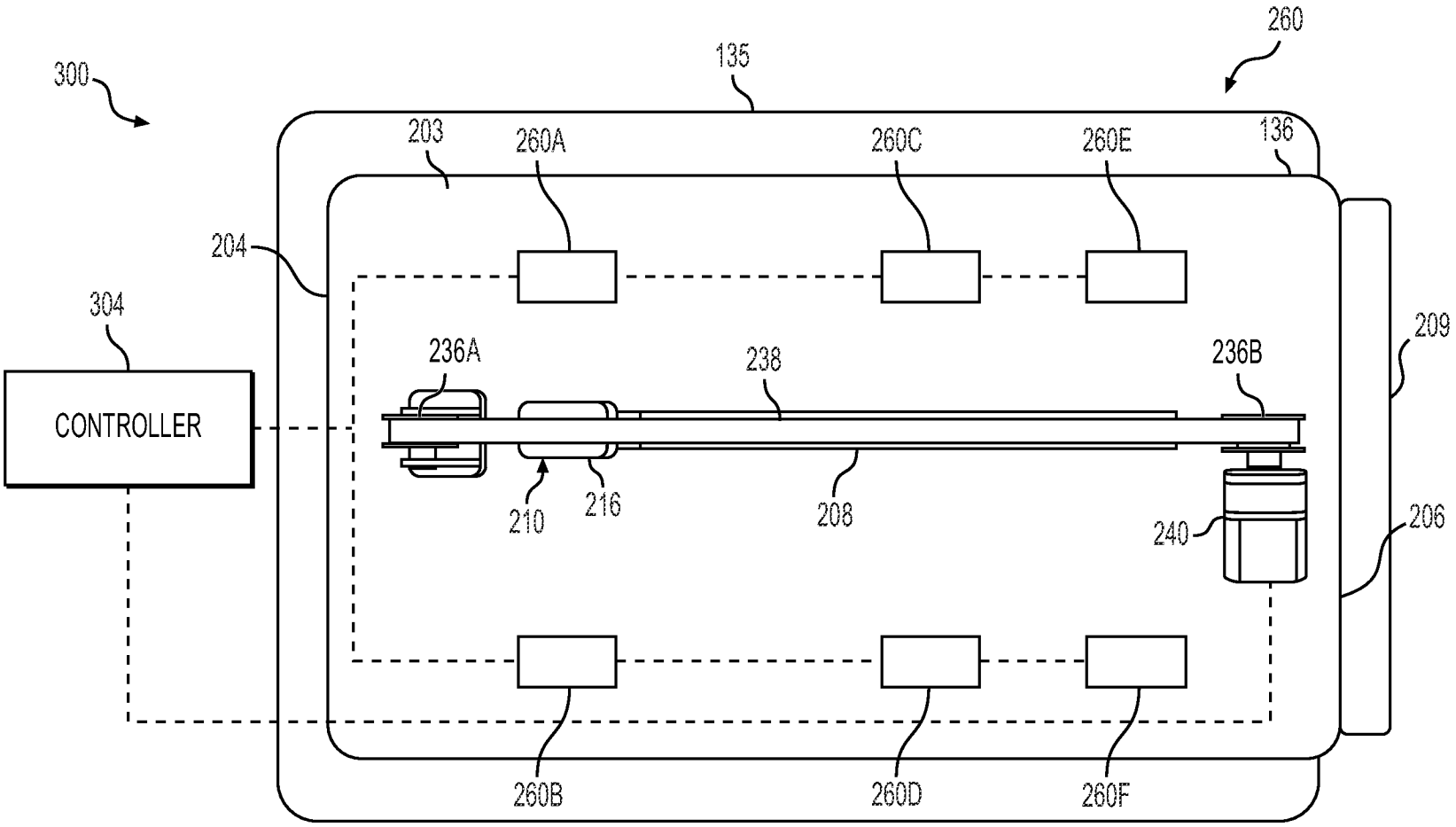
Figure 2C:
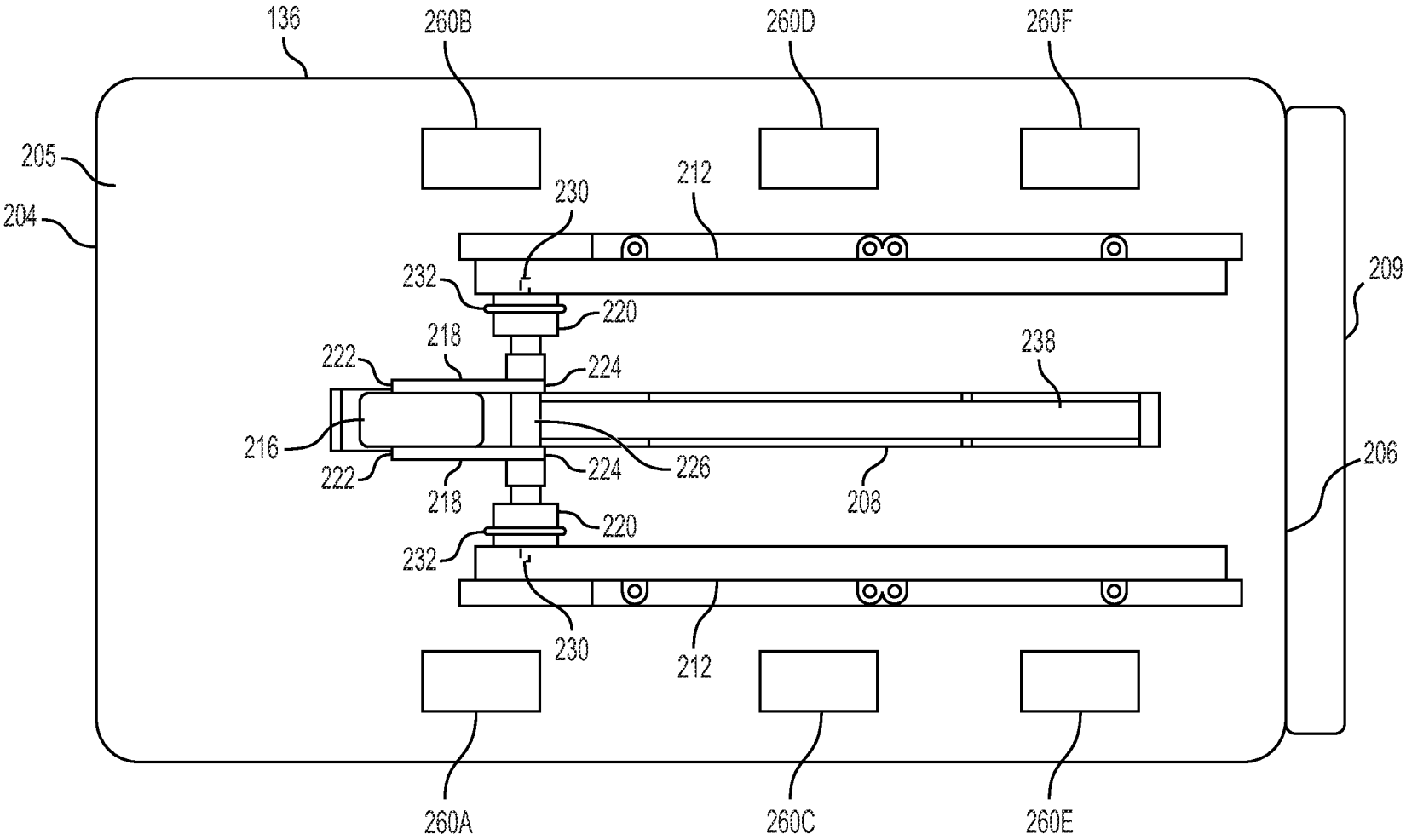

FIGS. 2A-2C depict various schematic views of an exemplary dispenser device 136 mounted on printer machine 135, according to one or more embodiments. FIG. 2A depicts a schematic side view of dispenser device 136 mounted on printer machine 135. FIG. 2B depicts a schematic top view of dispenser device 136 mounted on printer machine 135. FIG. 2C depicts a schematic bottom view of dispenser device 136 isolated from printer machine 135. As detailed above, printer machine 135 may include any type of printer machine 135 for printing documents, such as a printed document 150, and dispensing the printed documents. Printer machine 135 may include an output tray 201 (shown in dashed lines in FIG. 2A) onto which printed documents are dispensed. Output tray 201 may include a tray or bin where printed documents are delivered and held after being printed. As shown in FIG. 2A, output tray 201 may include a curved surface of printer machine 135 and printed documents may be dispensed from an internal passage (not shown) of printer machine 135 to output tray 201, in a conventional manner. A printed document 150 may include a leading edge 151 and a trailing edge 153. The leading edge 151 may include a forward edge of printed document 150 that leads or otherwise is dispensed out of printer machine 135 first. The trailing edge 153 may include a rear edge of printed document 150 that is the last edge of printed document 150 to be dispensed from printer machine 135.

Dispenser device 136 may interact with the printed document 150 to pull, push, or otherwise move the printed document 150 from the output tray 201 through a slot 209, as detailed further below. While printer machine 135 is depicted as including a curved output tray 201, it is understood that dispensing device 136 may be designed to be fitted to or otherwise mounted to any type of printer machine 135 having any type of output tray 201 (e.g., curved, angled, straight, flat, etc.).

As shown in FIGS. 2A-2C, dispenser device 136 may include a device or apparatus that is operationally mounted on printer machine 135. Dispenser device 136 may include a body 202 extending between a proximal, first end 204 and a distal, second end 206. As used herein, proximal may refer to a location nearest a side of output tray 201 where printed document 150 is initially dispensed, while distal may refer to a location nearest an opposite side of output tray 201 where leading edge 151 of printed document may rest prior to interaction with dispenser device 136. Body 202 may include a first, top side 203 and a second, bottom side 205. As used herein, top side 203 may include a side of body 202 that faces away from an output tray 201 of printer machine 135 when dispenser device 136 is operationally mounted to printer machine 135. As used herein, bottom side 205 may include a side opposite of top side 203 that faces toward output tray 201 of printer machine 135 when dispenser device 136 is operationally mounted to printer machine 135.

Body 202 may include a generally rectangular shape and may form a general body of dispenser device 136 for mounting or otherwise holding components of dispenser device 136, as detailed further below. Body 202 may include any shape, as necessary, and may correspond to a shape of printer machine 135, as detailed further below. Body 202 may be made of any material, such as plastics, composites, metals, or the like or combinations thereof. Body 202 may include an aperture that defines a guide 208 (shown in FIGS. 2B and 2C). Guide 208 may guide one or more components of dispensing device 136, as detailed further below.

Dispenser device 136 may also include a base 207 for attaching or otherwise connecting dispenser device 136 to printer machine 135. Body 202 may be attached or otherwise connected to base 207 by a spring loaded hinge 211 or similar mechanism. Accordingly, body 202 may be moved between an open (e.g., nonoperational) position and a closed (e.g., operational) position. FIGS. 2A-2C depict body 202 in the closed position. As detailed above, when the body 202 is in the closed position, the bottom side 205 of body 202 may face the output tray 201 of printer machine 135. The base 207 may be attached or otherwise connected to printer machine 135 for mounting dispensing device 136 to printer machine 135. For example, the base 207 may be attached to printer machine 135 via one or more bolts (not shown) or similar devices. It is understood that base 207 may be attached to printer machine 135 via any means, as desired, such as, for example, press fit, epoxy, or any other attachment means.

Slot 209 may include an additional part that may be attached or otherwise connected to body 202 and may extend from the bottom side 205 of body 202. Slot 209 may include an opening in the additional part and may extend distally from second end 206 of body 202. Slot 209 may include any size and/or shape as desired for dispensing a printed document 150 out of slot 209, as detailed further below. The additional part containing slot 209 may include a bump 219. A printed document 150 may be guided toward slot 209, as detailed below, and interact with bump 219 to be guided into and through slot 209. In some examples, slot 209 may be aligned with output tray 201 such that bump 219 may be omitted and a printed document 150 may be guided through slot 209 without interacting with bump 219. In some examples, the additional part containing slot 209 may be removed, and a general opening may be defined between the bottom side 205 of body 202 and output tray 201 of printer machine 135. In this way, a printed document 150 may be dispensed through the general opening rather than a slot 209.

Dispensing device 136 may include an arm mechanism 210, one or more tracks 212, and a pulley system 214. The arm mechanism 210, one or more tracks 212, and a pulley system 214 may each be mounted or otherwise connected to body 202. As shown in FIGS. 2A and 2C, arm mechanism 210 may include a support base 216, one or more arms 218, and one or more wheels 220. The one or more arms 218 may include elongate members that extend between a proximal, first end 222 and a distal, second end 224 (as labeled in FIG. 2C). The first end 222 of the one or more arms 218 may be attached or otherwise connected to support base 216. The one or more arms 218 may be attached to support base 216 by a spring loaded or biased hinge or similar mechanism such that the one or more arms 218 may move with respect to the support base 216.

The one or more wheels 220 may be attached or otherwise connected to a rod 226 or similar device (as shown in FIG. 2C). Rod 226 may be attached or otherwise connected to the second end 224 of the one or more arms 218. As shown in FIG. 2C, rod 226 may include a central longitudinal axis that is substantially perpendicular to a central longitudinal of the one or more arms 218 when rod 226 is connected to arms 218. The one or more wheels 220 may include a central longitudinal axis substantially aligned with the central longitudinal axis of the rod 226. The one or more wheels 220 may be attached to rod 226 such that the one or more wheels 220 do not rotate or otherwise spin. One or more pins 230 (shown by dashed lines in FIG. 2C) or similar devices may extend from each of the one or more wheels 220 along the central longitudinal axis of the one or more wheels 220. The one or more pins 230 may be inserted into or otherwise interact with the one or more tracks 212. Accordingly, the one or more wheels 220 may be guided along the one or more tracks 212 via the one or more pins 230, as detailed further below. For example, the one or more pins 230 may be rotatably attached to the one or more wheels 220 such that the one or more pins 230 may rotate or otherwise spin relative to the one or more wheels 220 to move the arm mechanism 210. In some examples, the one or more pins 230 may be attached to the one or more wheels 220 such that the one or more pins 230 do not rotate or otherwise spin. In such examples, the one or more pins 230 may slide along the one or more tracks 212 in order to move the arm mechanism 210.

The one or more wheels 220 may also include one or more O-rings 232 or similar devices attached thereon. The O-rings 232 may include elastomer members seated in a groove (not shown) of the one or more wheels 220. Friction between the O-rings 232 and a printed document 150, may grip or otherwise "grab" the printed document 150 for urging (e.g., pulling or pushing) the printed document 150, as detailed further below. It is understood that the O-rings 232 may include any type of material for inducing friction between the O-rings 232 and printed documents. In some examples, the one or more wheels 220 may include a material for inducing friction between the one or more wheels 220 and the printed documents for urging printed documents, such that the O-rings 232 (and any associated groove on the one or more wheels 220) may be omitted.

The one or more tracks 212 may include guides for guiding the one or more wheels 220 along the one or more tracks 212. The one or more tracks 212 may include a size and/or shape that corresponds to size and/or shape of an output tray 201 (shown in FIG. 2A) of printer machine 135. For example, the one or more tracks 212 may include a length that corresponds to a length of the output tray 201 such that the arm mechanism 210 may pull a printed document 150 from the output tray 201 and out of a slot 209 of dispensing device 136, as detailed further below. The shape of the one or more tracks 212 may include a shape such that the one or more wheels 220 may grab a printed document 150 and pull the printed document 150 towards the slot 209, as detailed further below. For example, the shape of the one or more tracks 212 may include various vertical lengths from which the one or more tracks 212 extend from the bottom side 205 of body 202 towards output tray 201.

As shown in FIGS. 2A and 2C, the one or more tracks 212 may include various vertical lengths in various locations along a horizontal length of the one or more tracks 212. The various vertical lengths may provide a path for the arm mechanism 210 to grab printed document 150 to pull printed document 150 towards slot 209, as detailed further below. The various vertical lengths may include a convex angle bend proximate a first position 213 of arm mechanism 210 such that the arm mechanism 210 may allow the leading edge 151 of printed document 150 to pass the first position 213. The arm mechanism 210 may then be controlled to move toward distal end 206 and around the convex bend to "grab" or otherwise interact with the printed document 150, as detailed further below. The vertical lengths may also include a convex bend adjacent a distal end of the one or more tracks 212 such that the arm mechanism 210 may urge the printed document 150 over bump 219 and into and through slot 209. A middle section of the one or more tracks 212 (e.g., between the convex bends) may include a vertical length from the bottom side 205 of body 202 such that arm mechanism 210 may continually grab printed document 150 to urge printed document 150 towards slot 209. The vertical length of the middle section of the one or more tracks 212 may generally correspond to a shape of output tray 201 adjacent the middle section of the one or more tracks 212. The vertical length of the middle section of the one or more tracks 212 may therefore include a generally consistent length such that wheels 220 of arm mechanism 210 may continually interact with printed document 150. Thus, the vertical lengths of the one or more tracks 212 may include lengths such that arm mechanism 210 may interact with printed document 150 and pull or otherwise urge printed document 150 towards and through slot 209.

The one or more tracks 212 may be mounted, monolithically formed with, or otherwise connected to the bottom side 205 of body 202 such that the one or more tracks 212 face the output tray 201 of printer machine 135. The one or more tracks 212 may each include an elongate slot (not shown) along the length of the one or more tracks 212. The one or more pins 230 may be inserted or otherwise connected to the elongate slots of the one or more tracks 212. In some examples, the one or more pins 230 may be slidably connected to the one or more tracks 212 on a bottom surface of the one or more tracks 212 such that the elongate slots may be omitted.

The pulley system 214 may be mounted or otherwise connected to the top side 203 of body 202. The pulley system 214 may include one or more fixed pulleys 236, an endless belt 238, and one or more motors 240. In the exemplary embodiment, pulley system 214 includes a first pulley 236A and a second pulley 236B (as shown in FIGS. 2A-2B). However, it is understood that the one or more pulleys 236 may include any number of pulleys, as desired. The first pulley 236A may be located adjacent the first end 204 of body 202, and second pulley 236B may be located adjacent the second end 206 of body 202. The one or more pulleys 236 may be mounted to the top side 203 of body 202 by, for example, bolts or the like, or by any attachment means, as desired.

As shown in FIGS. 2A-2B, the endless belt 238 may be passed over or otherwise looped around the one or more pulleys 236 such that the belt 238 may be rotated around the one or more pulleys 236. The one or more motors 240 may be coupled to at least one of the one or more pulleys 236 (e.g., second pulley 236B) in order to rotate the at least one pulley 236 such that the endless belt 238 is rotated around the one or more pulleys 236. For example, the belt 238 may be rotated clockwise and/or counter-clockwise.

The arm mechanism 210 may be attached or otherwise coupled to the belt 238 such that the rotation of the belt 238 causes the arm mechanism 210 to move along guide 208 of body 202. For example, a portion of support base 216 may extend through the guide 208 such that support base 216 of arm mechanism 210 extends from the top side 203 of body 202 to the bottom side 205 of body 202. The one or more arms 218 of arm mechanism 210 may be attached to the portion of support base 216 that extends past the bottom side 205 of body 202 (as shown in FIGS. 2A and 2B). When belt 238 rotates, arm mechanism 210 may move along the guide 208, and wheels 220 may move and be guided by the one or more tracks 212 for urging (e.g., pulling) a printed document towards, and out of, slot 209, as detailed further below. Thus, arm mechanism 210 may be moveably coupled to body 202. The arm mechanism 210 is shown in various positions, as indicated by the dashed lines in FIG. 2A. For example, arm mechanism 210 is shown in dashed lines in a first position 213, in dashed lines in a second position 215, and in solid lines at a third position 217, as detailed further below.

Dispenser device 136 may also include a dispensing control system 300 (shown schematically in FIG. 2B). Dispensing control system 300 includes a controller 304, such as a microcontroller, and a sensor system 260 connected to controller 304. The sensor system 260 may include one or more sensors 260A-260F for sensing a printed document 150 in output tray 201. For example, the one or more sensors 260A-260F may include one or more optical sensors 260A-260F. The one or more optical sensors 260A-260F may include optical sensors that convert light rays into electronic signals. Thus, when an object, such as a printed document 150, passes by a respective optical sensor 260A-260F, the respective optical sensor 260A-260F may detect a change in light and indicate that the printed document 150, or a portion thereof (e.g., leading edge 151 and/or trailing edge 153), has passed or otherwise triggered the respective optical sensor 260A-260F, as detailed further below. While optical sensors are described herein, it is understood that the one or more sensors 260A-260F may include any type of sensor for detecting a presence of an object (e.g., a printed document 150). Further, the one or more optical sensors 260A-260F may include a first optical sensor 260A, a second optical sensor 260B, a third optical sensor 260C, a fourth optical sensor 260D, a fifth optical sensor 260E, and a sixth optical sensor 260F. In some examples, the one or more optical sensors 260A-260F may include more or fewer optical sensors.

The one or more optical sensors 260A-260F may be located on body 202 and may be positioned to detect a printed document 150 at various locations as the arm mechanism 210 pulls the printed document 150 towards slot 209, as detailed further below. In the example of FIGS. 2A-2C, the sensor system 260 may include two such sensors at each axial position on body 202 for providing redundancy in detecting a printed document 150. For example, first optical sensor 260A and second optical sensor 260B may be located at approximately the same axial position, and may be located to detect the leading edge 151 of printed document 150 as the printed document 150 is being printed and output onto output tray 201. The third optical sensor 260C and fourth optical sensor 260D may be located at approximately the same axial position on body 202, and may be located to detect the leading edge 151 of the printed document 150 after the printed document 150 has been "grabbed" by the arm mechanism 210, as detailed further below. The fifth optical sensor 260E and sixth optical sensor 260F may be locate at approximately the same axial position on body 202, and may be located to detect the leading edge 151 of the printed document 150 just prior to the leading edge 151 being ejected out of slot 209, as detailed further below. The one or more sensors 260A-260F may also detect the trailing edge 153 of printed document 150 when the trailing edge 153 has passed or otherwise come within proximity of a respective sensor 260A-260F. Thus, the one or more sensors 260A-260F may detect when the printed document 150 has moved beyond each of the respective one or more sensors 260A-260F.

Controller 304 may also be in communication with motor 240 for controlling a movement of arm mechanism 210. For example, controller 304 may control a speed and rotation direction of motor 240 to control a movement direction of arm mechanism 210, as detailed further below.

Figure 3:
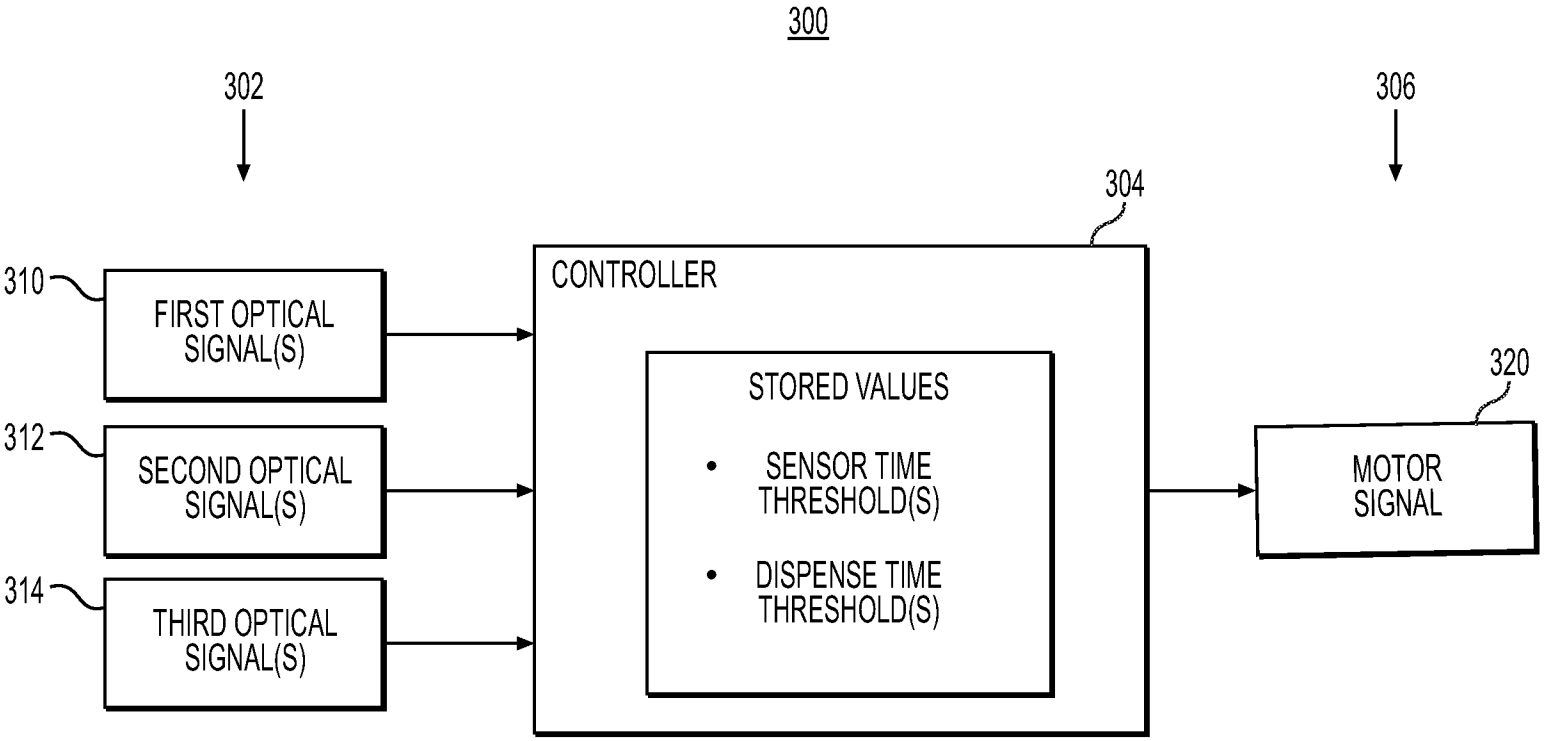
FIG. 3 depicts a schematic view of an exemplary dispensing control system for the system architecture of FIG. 1.

FIG. 3 depicts a schematic view of the exemplary dispensing control system 300 for operation and/or control of at least portions of dispenser device 136, according to one or more embodiments. System 300 may include inputs 302, controller 304, and outputs 306. Inputs 302 may include, for example, one or more first optical signals 310 from first optical sensor 260A and/or second optical sensor 260B, one or more second optical signals 312 from third optical sensor 260C and/or fourth optical sensor 260D, and/or one or more third optical signals 314 from fifth optical sensor 260E and/or sixth optical sensor 260F. Output 306 may include, for example, a motor signal 320 for controlling a speed and rotation direction of motor 240. Controller 304 may receive inputs 302, implement a method 400 for dispensing a printed document from printer machine 135 with a dispensing device 136, and control output 306, as described with reference to FIG. 4 below.

Controller 304 may embody a single microprocessor or multiple microprocessors that may include means for dispensing a printed document from a printer machine 135 with a dispensing device 136. For example, controller 304 may include a memory, a secondary storage device, and a processor, such as a central processing unit or any other means for accomplishing a task consistent with the present disclosure. The memory or secondary storage device associated with controller 304 may store data and/or software routines that may assist controller 304 in performing its functions, such as the functions of method 400 of FIG. 4. Further, the memory or secondary storage device associated with controller 304 may also store data received from the various inputs 302 associated with dispensing control system 300. Numerous commercially available microprocessors can be configured to perform the functions of controller 304. It should be appreciated that controller 304 could readily embody a general machine controller capable of controlling numerous other machine functions. Various other known circuits may be associated with controller 304, including signal-conditioning circuitry, communication circuitry, hydraulic or other actuation circuitry, and other appropriate circuitry.

Controller 304 may also include stored and/or derived values for use by controller 304. For example, the stored and/or derived values may include one or more sensor time thresholds and one or more dispense time thresholds. The one or more sensor time thresholds may include time thresholds or limits for sensing a printed document between the various sensors 260A-260F. For example, the one or more sensor time thresholds may include a first time threshold and a second time threshold. The first time threshold may be a predetermined time limit between the first and/or second optical sensors 260A, 260B and the third and/or fourth optical sensors 260C, 260D. For example, if the amount of time between the first and/or second optical sensors 260A, 260B being triggered and the third and/or fourth optical sensors 260C, 260D being triggered exceeds the first time threshold, controller 304 may control motor 240 to stop and/or reverse direction, as detailed further below.

The second time threshold may be a predetermined time limit between the third and/or fourth optical sensors 260C, 260D and the fifth and/or sixth optical sensors 260E, 260F. For example, if the amount of time between the third and/or fourth optical sensors 260C, 260D being triggered and the fifth and/or sixth optical sensors 260E, 260F being triggered exceeds the second time threshold, controller 304 may control motor 240 to stop and/or reverse direction, as detailed further below.

The one or more dispense time thresholds may include a third time threshold. The third time threshold may be a predetermined time limit between the fifth and/or sixth optical sensors 260E, 260F detecting the leading edge of the printed document and detecting a trailing edge of the printed document. For example, the fifth and/or sixth optical sensors 260E, 260F detecting the leading edge may indicate the printed document has been dispensed out of slot 209. The fifth and/or sixth optical sensors 260E, 260F detecting the trailing edge of the printed document may indicate that the printed document has been removed by a user from the slot 209, as detailed further below. The third time threshold may include a time limit on the amount of time the user has to obtain the printed document and remove the printed document from slot 209.

Motor signal 320 may include control of aspects of motor 240. For example, controller 304 may control the rotational direction and/or speed of motor 240 for controlling movement of arm mechanism 210.

Figure 4:
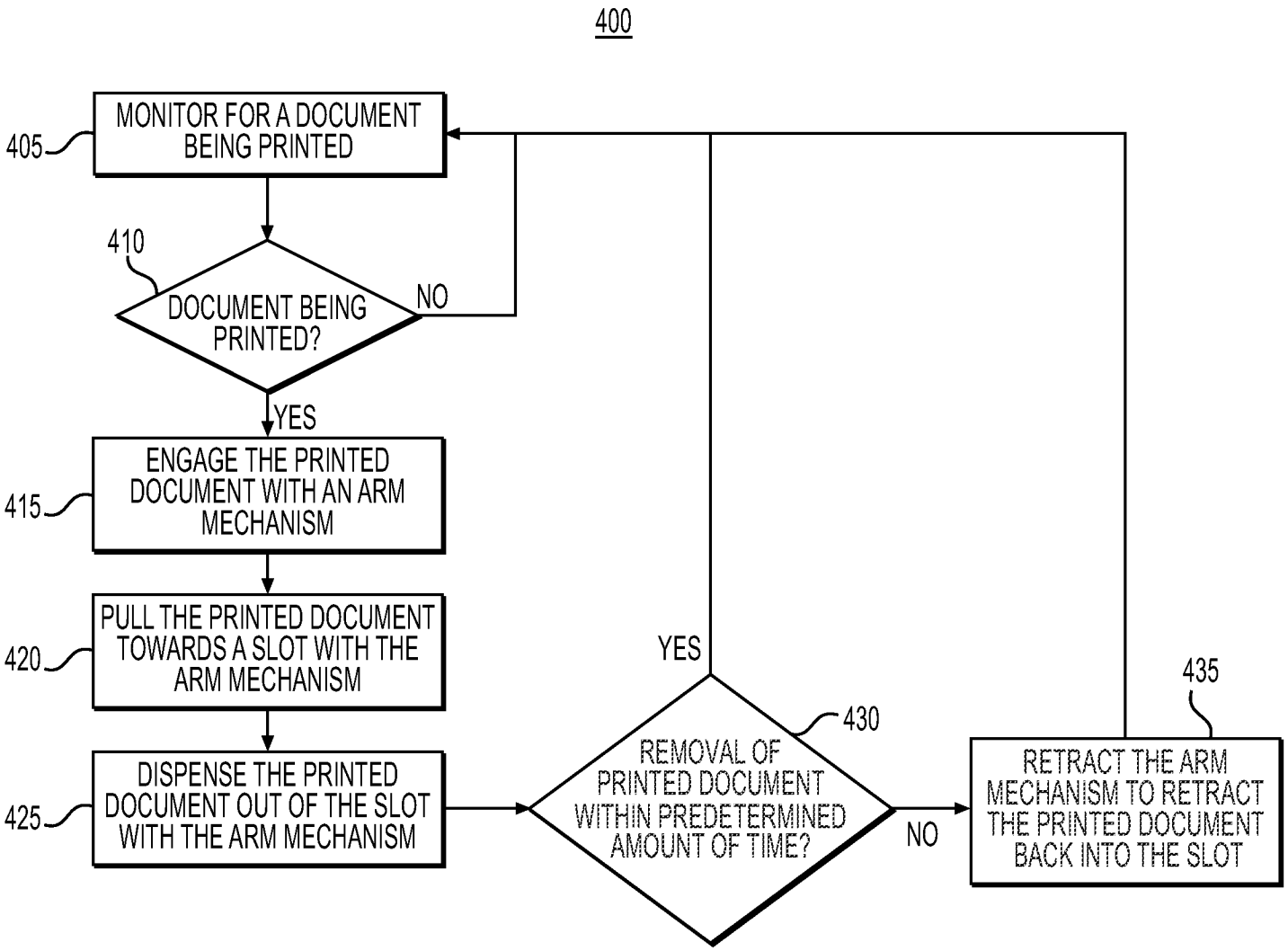
FIG. 4 depicts a flowchart of an exemplary method for dispensing a printed document from a printer machine using a dispenser device, according to one or more embodiments.

FIG. 4 depicts a flowchart of an exemplary method 400 for dispensing a printed document from a printer machine 135 with a dispensing device 136, according to one or more embodiments. In step 405, controller 304 may monitor for a document being printed (e.g., a printed document 150) out from the printer machine 135. For example, controller 304 may receive the one or more first optical signals 310.

In step 410, controller 304 may determine whether a document is being printed out from the printer machine 135. For example, controller 304 may receive the one or more first optical signals 310 from first and/or second optical sensor 260A, 260B. Controller 304 may determine that a document is being printed out from the printer machine when the first and/or second optical sensor 260A, 260B detect the leading edge 151 of printed document 150, as detailed above. For example, as printed document 150 is being printed out by printer machine 135 and dispensed onto output tray 201, the leading edge 151 may pass or otherwise come within proximity of optical sensors 260A, 260B. The optical sensors 260A, 260B may detect a change in light due to the leading edge 151 and may send an electrical signal (e.g., optical signals 310) to controller 304. Controller 304 may receive the optical signals 310 that indicate the change in light and may determine that a document is being printed. Controller 304 may determine that a document is not being printed if the leading edge 151 of printed document 150 is not detected by the first and/or second optical sensors 260A, 260B. If a document is not being printed out (step 410: NO), controller 304 may continue to monitor for a document being printed.

In accordance with a determination that a document is being printed out (step 410: YES), controller 304 may engage the printed document 150 with arm mechanism 210 (step 415). For example, when the first and/or second optical sensors 260A, 260B have detected the leading edge 151 of printed document 150, controller 304 may control motor 240 to rotate belt 238 such that the arm mechanism 210 moves toward the proximal end of the one or more tracks 212 to the first position 213. In this way, controller 304 may move arm mechanism 210 the first position 213.

As the leading edge 151 of printed document 150 moves past or axially beyond (e.g., toward the distal end 206 of body 202) the first position 213 of arm mechanism 210, controller 304 may control motor 240 to move arm mechanism 210 axially towards the distal end 206 of body 202. In this way, controller 304 may move arm mechanism 210 towards the distal end 206 of body 202 and the one or more wheels 220 of arm mechanism 210 may contact the printed document 150 and engage the printed document 150 via a friction grip between the wheels 220 and the printed document 150. For example, the O-rings 232 may provide a friction force against printed document 150 such that the wheels 220 may grip the printed document 150 when the O-rings 232 contact the printed document 150. Thus, controller 304 may engage the printed document 150 with arm mechanism 210.

In step 420, when the controller 304 has engaged the printed document 150 with arm mechanism 210, controller 304 may pull the printed document 150 towards slot 209 with the arm mechanism 210. For example, controller 304 may continue to control motor 240 to move arm mechanism 210 towards the distal end 206 of body 202. In this way, the arm mechanism 210 may urge (e.g., pull) the printed document 150 via the friction grip between wheels 220 and printed document 150. Thus, arm mechanism 210 may be moved through the second position 215, and the leading edge 151 of printed document 150 may be detected by the third and/or fourth optical sensors 260C, 260D. Thus, controller 304 may determine that the arm mechanism 210 has successfully gripped or "grabbed" the printed document 150 and is moving the printed document 150 toward the distal end 206 of body 202 (e.g., toward slot 209).

In step 425, controller 304 may dispense the printed document 150 out of slot 209 with arm mechanism 210. For example, controller 304 may continue to control motor 240 to move arm mechanism 210 towards distal end 206 of body 202. In this way, arm mechanism 210 may continue to pull or otherwise move printed document 150 via the friction grip between wheels 220 and printed document 150. Thus, the leading edge 151 of printed document 150 may be detected by the fifth and/or sixth optical sensors 260E, 260F. Thus, controller 304 may determine that arm mechanism 210 continues to successfully move printed document 150 toward slot 209. When arm mechanism 210 has been moved to the distal end 206 of body 202, leading edge 151 of printed document 150 may be dispensed out of slot 209. Thus, a portion of printed document 150 may be dispensed out of slot 209 such that a user may obtain or otherwise retrieve printed document 150 from slot 209.

In some examples, controller 304 may determine a status of the printed document 150 and output an indication of the status of the printed document 150. For example, controller 304 may output the status to computer system 110, and computer system 110 may provide the status to computing device 120. Controller 304 may determine the status of the printed document 150 based on one or more of the optical sensors 260A-260F being triggered. For example, when the leading edge 151 of printed document 150 has triggered the first and/or second optical sensors 260A, 260B, controller 304 may determine that printed document 150 is being printed and may begin method 400, as detailed above. When the leading edge 151 of printed document 150 has triggered the third and/or fourth optical sensors 260C, 260D, controller 304 may determine that the printed document 150 is halfway to being dispensed and arm mechanism 210 is still pulling printed document 150 toward slot 209. When the leading edge 151 of printed document 150 has triggered the fifth and/or sixth optical sensors 260E, 260F, controller 304 may determine that printed document 150, or a portion thereof, has been dispensed out of slot 209.

Controller 304 may also determine a status of the printed document 150 based on the trailing edge 153 triggering any of the optical sensors 260A-260F, as detailed above. For example, if the trailing edge 153 triggers the fifth and/or sixth optical sensors 260E, 260F, controller 304 may determine that the printed document 150 has been removed from slot 209 by a user. Controller 304 may generate a status indication based on the above, and may output the status indication, as detailed above.

In some examples, controller 304 may determine an amount of time between optical sensors 260A-260F being triggered. For example, controller 304 may determine a first amount of time between the first and/or second optical sensors 260A, 260B being triggered and the third and/or fourth optical sensors 260C, 260D being triggered. Controller 304 may compare the first amount of time to the first time threshold, as detailed above. If the first amount of time is greater than the first time threshold, controller 304 may determine there is a jam or some other error, and may stop movement of arm mechanism 210. Similarly, controller 304 may determine a second amount of time between the third and/or fourth optical sensors 260C, 260D being triggered and the fifth and/or sixth optical sensors 260E, 260F being triggered. Controller 304 may compare the second amount of time to the second time threshold, as detailed above. If the second amount of time is greater than the second time threshold, controller 304 may determine that there is a jam or some other error has occurred, and may stop movement of arm mechanism 210.

In step 430, controller 304 may determine whether printed document 150 has been removed from slot 209 within a predetermined amount of time. In some examples, in step 430, controller 304 may determine an amount of time that has passed after the fifth and/or sixth optical sensors 260E, 260F have been triggered by the leading edge 151 and the trailing edge 153 of printed document 150. For example, controller 304 may determine a third amount of time. The third amount of time may correspond to an amount of time that the leading edge 151 has been dispensed out of slot 209 prior to being retrieved or otherwise removed from slot 209 by the user. If printed document 150 has been retrieved or otherwise removed from slot 209 by the user before the third amount of time becomes greater than the third time threshold, as detailed above, then the method 400 may return to step 405, where controller 304 may monitor for a next document to be printed out from the printer machine 135. Otherwise, if the third amount of time is greater than the third time threshold, as detailed above, and printed document 150 has not yet been retrieved or otherwise removed, controller 304 may determine that the user has not retrieved or removed the printed document 150 in sufficient time. In such instances, controller 304 may control motor 240 to move arm mechanism 210 back toward proximate end 204 of body 202. For example, in step 435, controller 304 may retract arm mechanism 210 to retract printed document 150 back into (e.g., within) the slot. In this way, printed document 150 may be moved back within slot 209 such that leading edge 151 may no longer be disposed out of slot 209. Controller 304 may then notify or otherwise send an alert to computer system 110 and a technician or another user may be notified. The technician may open dispensing device 136, as detailed above, to retrieve printed document 150 and dispose of printed document 150. Thus, dispensing device 136 may provide for increased security for certain types of documents to prevent unauthorized users from retrieving printed document 150. After the technician retrieves and disposes printed document 150, then the method 400 may return to step 405, where controller 304 may monitor for a next document to be printed out from the printer machine 135.

In some instances, a printed document 150 may become misaligned on output tray 201 as arm mechanism 210 urges printed document 150 towards slot 209. In such instances, the printed document 150 may jam or otherwise may be unable to be urged through slot 209. Accordingly, controller 304 may determine misalignment of a printed document 150 on output tray 201 as arm mechanism 210 is urging the printed document 150 towards slot 209. For example, controller 304 may determine a printed document 150 is misaligned based on the signals 310-314 from the optical sensors 260A-260F. Such instances may include: if first optical sensor 260A is triggered before second optical sensor 260B; if second optical sensor 260B is triggered before first optical sensor 260B; if third optical sensor 260C is triggered before fourth optical sensor 260D; if fourth optical sensor 260D is triggered before third optical sensor 260C; if fifth optical sensor 260E is triggered before sixth optical sensor 260F; and/or if sixth optical sensor 260F is triggered before fifth optical sensor 260E. Upon determining that printed document 150 is misaligned, controller 304 may stop the arm mechanism 210 and may generate and send an alert to computer system 110 that a jam has occurred.

In general, any process or operation discussed in this disclosure that is understood to be computer-implementable, such as the processes illustrated in FIG. 4, may be performed by one or more processors of a computer system, such any of the systems or devices in the environment 100 of FIG. 1, as described above. A process or process step performed by one or more processors may also be referred to as an operation. The one or more processors may be configured to perform such processes by having access to instructions (e.g., software or computer-readable code) that, when executed by the one or more processors, cause the one or more processors to perform the processes. The instructions may be stored in a memory of the computer system. A processor may be a central processing unit (CPU), a graphics processing unit (GPU), or any suitable types of processing unit.

A computer system, such as a system or device implementing a process or operation in the examples above, may include one or more computing devices, such as one or more of the systems or devices in FIG. 1. One or more processors of a computer system may be included in a single computing device or distributed among a plurality of computing devices. A memory of the computer system may include the respective memory of each computing device of the plurality of computing devices.

FIG. 5 is a simplified functional block diagram of a computer 500 that may be configured as a device for executing the method of FIG. 4, according to exemplary embodiments of the present disclosure. For example, the computer 500 may be configured as a portion of the document printing device 130 and/or another system according to exemplary embodiments of this disclosure. In various embodiments, any of the systems herein may be a computer 500 including, for example, a data communication interface 520 for packet data communication. The computer 500 also may include a central processing unit ("CPU") 502, in the form of one or more processors, for executing program instructions. The computer 500 may include an internal communication bus 508, and a storage unit 506 (such as ROM, HDD, SDD, etc.) that may store data on a computer readable medium 522, although the computer 500 may receive programming and data via network communications. The computer 500 may also have a memory 504 (such as RAM) storing instructions 524 for executing techniques presented herein, although the instructions 524 may be stored temporarily or permanently within other modules of computer 500 (e.g., processor 502 and/or computer readable medium 522). The computer 500 also may include input and output ports 512 and/or a display 510 to connect with input and output devices such as keyboards, mice, touchscreens, monitors, displays, etc. The various system functions may be implemented in a distributed fashion on a number of similar platforms, to distribute the processing load. Alternatively, the systems may be implemented by appropriate programming of one computer hardware platform.

Program aspects of the technology may be thought of as "products" or "articles of manufacture" typically in the form of executable code and/or associated data that is carried on or embodied in a type of machine-readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer of the mobile communication network into the computer platform of a server and/or from a server to the mobile device. Thus, another type of media that may bear the software elements includes optical, electrical and electromagnetic waves, such as used across physical interfaces between local devices, through wired and optical landline networks and over various airlinks. The physical elements that carry such waves, such as wired or wireless links, optical links, or the like, also may be considered as media bearing the software. As used herein, unless restricted to non-transitory, tangible "storage" media, terms such as computer or machine "readable medium" refer to any medium that participates in providing instructions to a processor for execution.

While the disclosed methods, devices, and systems are described with exemplary reference to transmitting data, it should be appreciated that the disclosed embodiments may be applicable to any environment, such as a desktop or laptop computer, an automobile entertainment system, a home entertainment system, etc. Also, the disclosed embodiments may be applicable to any type of Internet protocol.

It should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Thus, while certain embodiments have been described, those skilled in the art will recognize that other and further modifications may be made thereto without departing from the spirit of the invention, and it is intended to claim all such changes and modifications as falling within the scope of the invention. For example, functionality may be added or deleted from the block diagrams and operations may be interchanged among functional blocks. Steps may be added or deleted to methods described within the scope of the present invention.

The above disclosed subject matter is to be considered illustrative, and not restrictive, and the appended claims are intended to cover all such modifications, enhancements, and other implementations, which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description. While various implementations of the disclosure have been described, it will be apparent to those of ordinary skill in the art that many more implementations are possible within the scope of the disclosure. Accordingly, the disclosure is not to be restricted except in light of the attached claims and their equivalents.

What is claimed is:

1. A method for dispensing a printed document from a printer machine with a dispensing device, the method comprising:

monitoring for a document being printed out from the printer machine;

based on the monitoring, determining that a document is being printed out from the printer machine;

engaging the printed document with an arm mechanism of the dispensing device, wherein a first portion of the arm mechanism is attached to a belt of the dispensing device that is configured to rotate to move the arm mechanism linearly along a track of the dispensing device, and a second portion of the arm mechanism contacts a surface of the printed document to engage the printed document;

urging the printed document towards a slot of the dispensing device with the arm mechanism moved by a rotation of the belt; and dispensing the printed document out of the slot with the arm mechanism.

2. The method of claim 1, wherein engaging the printed document with the arm mechanism includes:

engaging the printed document with one or more wheels of the second portion of the arm mechanism via a friction grip.

3. The method of claim 1, further including:

in accordance with a determination that a document is being printed out from the printer machine, moving the arm mechanism to a first position adjacent a proximal end of the track.

4. The method of claim 3, further including:

moving the arm mechanism towards a distal end of the track to engage the printed document and urge the printed document towards the slot.

5. The method of claim 1, further including detecting the printed document using one or more sensors, wherein each of the one or more sensors is triggered as the printed document passes a respective one of the one or more sensors.

6. The method of claim 5, wherein the one or more sensors includes a plurality of sensors, and the method further includes:

determining an amount of time between a triggering of a first sensor of the plurality of sensors and a triggering of a second sensor of the plurality of sensors by the printed document;

comparing the amount of time to a predetermined time threshold; and based on the comparing, stopping movement of the arm mechanism if the amount of time exceeds the predetermined time threshold.

7. The method of claim 5, further including:

determining an amount of time between the printed document being dispensed out of the slot and the printed document being removed from the slot;

comparing the amount of time to a predetermined time threshold; and based on the comparing, retracting the arm mechanism to retrieve the printed document back into the slot if the amount of time exceeds the predetermined time threshold.

8. The method of claim 1, wherein the dispensing device includes a pulley system including one or more pulleys and the belt looped around the one or more pulleys, the method further including:

moving the arm mechanism via the pulley system.

9. The method of claim 1, wherein the dispensing device is mounted to the printer machine.

10. The method of claim 1, wherein:

the first portion of the arm mechanism includes a base, the second portion of the arm mechanism includes one or more arms each having a first end attached to the base and a second end attached to one or more wheels, and the one or more wheels contact the surface of the printed document to engage the printed document.

11. A printed document dispensing system, comprising:

a printer machine; and a dispensing device mounted to the printer machine, the dispensing device including:

a body having a slot;

an arm mechanism moveably coupled to the body via a first portion of the arm mechanism, and a second portion of the arm mechanism including one or more engagement devices; and a controller configured to:

monitor for a document being printed out from the printer machine;

based on the monitoring, determine that a document is being printed out from the printer machine;

engage the printed document with the arm mechanism, wherein the one or more engagement devices contact a surface of the printed document to engage the printed document;

urge the printed document towards the slot with the arm mechanism as the arm mechanism is moved towards the slot via the first portion while the printed document is engaged; and dispense the printed document out of the slot with the arm mechanism.

12. The system of claim 11, wherein the one or more engagement devices include one or more wheels of the arm mechanism that engage the printed document via a friction grip.

13. The system of claim 11, wherein the dispensing device further includes a track mounted to the body, and wherein the controller is further configured to:

move the arm mechanism axially along the track of the dispensing device.

14. The system of claim 13, wherein the controller is further configured to:

in accordance with a determination that a document is being printed out from the printer machine, move the arm mechanism to a first position adjacent a proximal end of the track.

15. The system of claim 14, wherein the controller is further configured to:

move the arm mechanism towards a distal end of the track to engage the printed document and urge the printed document towards the slot.

16. The system of claim 11, wherein dispensing device further includes one or more sensors, and wherein the controller is further configured to:

detect the printed document using the one or more sensors, wherein each of the one or more sensors is triggered as the printed document passes a respective one of the one or more sensors.

17. The system of claim 16, wherein the one or more sensors include a plurality of sensors, and the controller is further configured to:

determine an amount of time between a triggering of a first sensor of the plurality of sensors and a triggering of a second sensor of the plurality of sensors by the printed document;

compare the amount of time to a predetermined time threshold; and based on the comparing, stop movement of the arm mechanism if the amount of time exceeds the predetermined time threshold.

18. The system of claim 16, wherein the controller is further configured to:

determine an amount of time between the printed document being dispensed out of the slot and the printed document being removed from the slot;

compare the amount of time to a predetermined time threshold; and based on the comparing, retract the arm mechanism to pull the printed document back into the slot if the amount of time exceeds the predetermined time threshold.

19. The system of claim 11, wherein the dispensing device includes a pulley system including one or more pulleys and an endless belt looped around the one or more pulleys, and wherein the controller is further configured to:

move the arm mechanism via the pulley system.

20. A method for dispensing a printed document from a printer machine with a dispensing device, the method comprising:

monitoring for a document being printed out from the printer machine using one or more sensors;

when at least one of the one or more sensors is triggered, determining that a document is being printed out from the printer machine;

engaging the printed document with one or more wheels of an arm mechanism of the dispensing device via a friction grip, the one or more wheels contacting a surface of the printed document to engage the printed document;

moving the arm mechanism axially along a track of the dispensing device to urge the printed document towards a slot of the dispensing device with the arm mechanism; and dispensing the printed document out of the slot with the arm mechanism.

* * * * *